United States Patent [19]

An

[11] Patent Number: 4,757,563

[45] Date of Patent: Jul. 19, 1988

[54] CONVENIENT HAMMOCK

[76] Inventor: Young N. An, 194-6 Nakmin-dong, Dongnae-ku, Busan, Rep. of Korea

[21] Appl. No.: 90,541

[22] Filed: Aug. 28, 1987

Related U.S. Application Data

[62] Division of Ser. No. 870,521, Jun. 4, 1986, abandoned.

[51] Int. Cl.[4] ..... A45F 3/24; A45F 3/22

[52] U.S. Cl. ..... 5/121; 5/128; 135/95; 135/106; 135/117

[58] Field of Search ..... 5/121, 120, 122, 127, 5/128, 113, 414; 135/95, 106, 117

[56] References Cited

U.S. PATENT DOCUMENTS

| | | | |
|---|---|---|---|
| 298,515 | 5/1984 | Sutphen | 5/130 |
| 769,913 | 9/1904 | Noble | 5/128 |
| 811,166 | 1/1906 | Nuessen | 5/128 |
| 957,644 | 5/1910 | Berger | 5/122 |
| 1,011,789 | 12/1911 | Hoffman | 5/128 |
| 1,054,251 | 2/1913 | Stone | 5/128 |
| 1,062,950 | 5/1913 | Boss | 5/121 |
| 4,229,845 | 10/1980 | De Cuados | 5/121 |

FOREIGN PATENT DOCUMENTS

| | | | |
|---|---|---|---|
| 2742655 | 5/1979 | Fed. Rep. of Germany | 5/121 |

*Primary Examiner*—Alexander Grosz

*Attorney, Agent, or Firm*—Birch, Stewart, Kolasch & Birch

[57] ABSTRACT

A hammock comprising main supporting rods connected together by an extension member, support members connected to the main supporting rods through end connecting members, rod holding members pivotally connected to the end connecting members, a folding shade parasol attached to the rod holding members, and a hammock bed mounted on the connecting members.

3 Claims, 3 Drawing Sheets

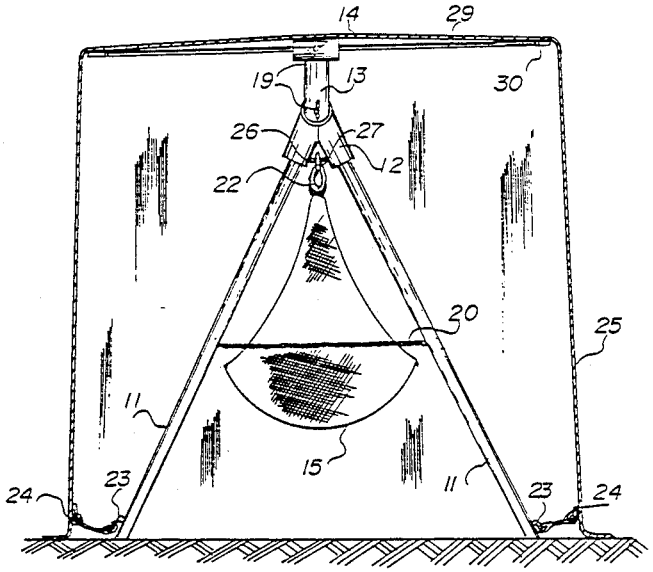
FIG 3
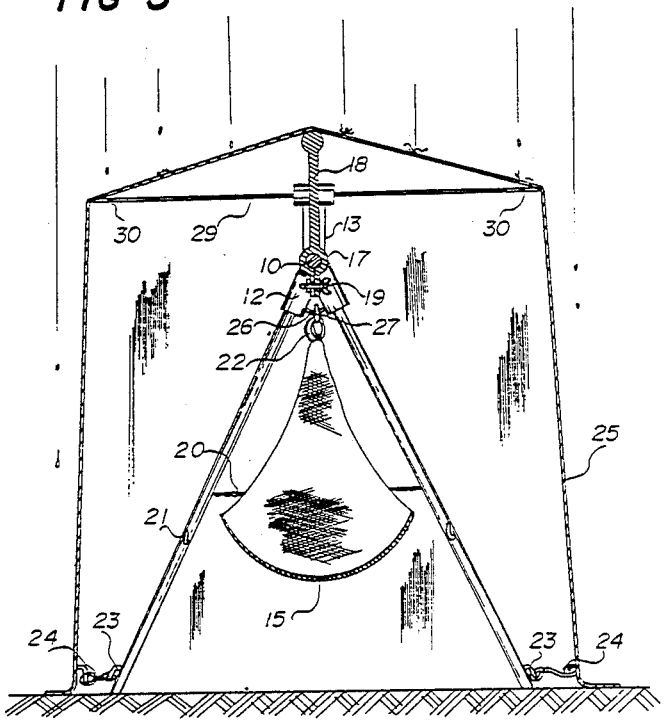
FIG 4
FIG. 5
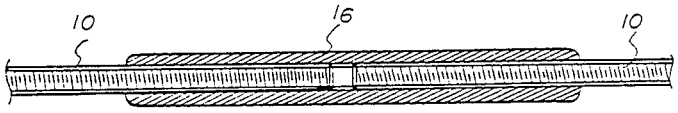

CONVENIENT HAMMOCK

This application is a divisional of copending application Ser. No. 870,521, filed on June 4, 1986, now abandoned.

BACKGROUND OF THE INVENTION

The present invention relates to a hammock for use in the outdoors, such as in the park or in the yard, and more particularly, to a swinging hammock made of netting, supported by support members and covered with a removable plate.

Swinging beds are known which are adapted to be attached to trees or poles. However, there are many problems with the prior art hammocks, that is, (1) the limited length of the known devices, which makes it difficult to connect the hammock between adjacent trees; (2) the prior art devices cannot be utilized where there are no supports; (3) it is difficult to block the sunshine in the maner of a beach parasol; and (4) the prior art devices do not have the alternate functions of a tent.

OBJECTS AND SUMMARY OF THE INVENTION

Accordingly, it is an object of the present invention to provide an improved multi-purpose hammock.

Another object of the present invention is to provide a swinging hammock or bed which is provided with support members and a bed made of netting.

Still another object of the present invention is to provide an improved hammock which is covered with an adjustable sun blocking parasol.

A further object of the present invention is to provide a hammock having a full cover so that the hammock can be used as a tent.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a hammock which comprises main supporting rods extended by an extension member, support members connected to the main supporting rods through connecting members, holding members pivotally connected to the connecting member, a folding shade parasol, and a netting bed mounted to the connecting members whereby the hammock is convenient to use and easy and simple to assemble and manufacture.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a side view showing how the hammock can be used as a tent;

FIG. 4 is a side view showing the sunshine blocking parasol in position as a roof;

FIG. 5 is a sectional view showing an extension portion of an extension rod utilized in the present invention.;

DETAILED DESCRIPTION OF THE DRAWINGS

Figure 1:
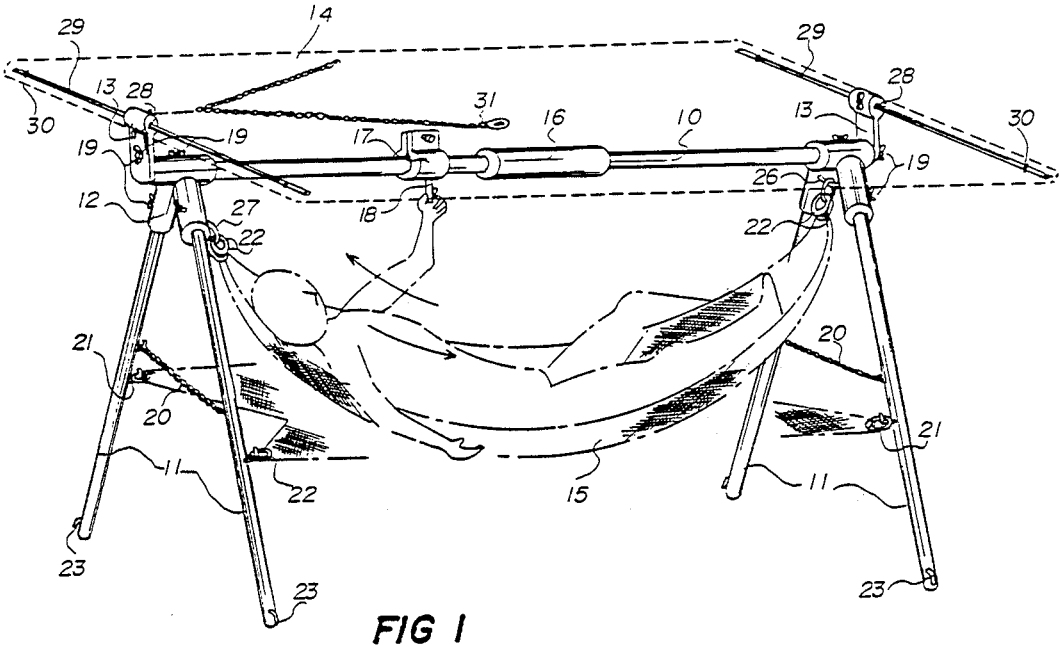
FIG. 1 is a perspective view of the improved hammock of the present invention.
Figure 2:
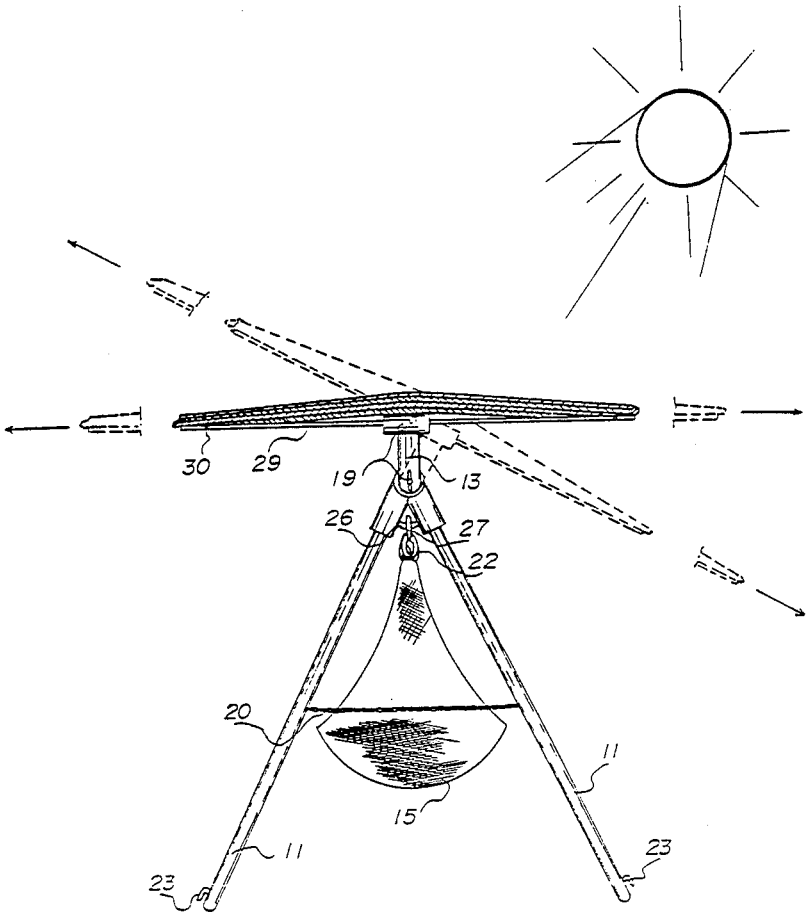
FIG. 2 is a side view showing how the sunshine-blocking parasol can be sloped to block the sunshine.

Referring now in detail to the drawings for the purpose of illustrating the present invention, the improved hammock as shown in FIGS. 1 and 2 comprises main supporting rods 10, support members 11 connected to the main supporting rods 10 through connecting members 12, holding members 13 pivotally connected to the connecting members 12, a folding shade parasol 14, and a netting bed 15 which is mounted to the connecting members 12.

One main supporting rod 10 is connected to a second main supporting rod 10 through an extension member 16 which is internally threaded for screw engagement with the external threads in the end portions of the rods so that the total length of the main supporting rods can be adjusted for controlling the tightness of the netting bed 15.

The extension member 16 can be replaced with another kind of device wherein the separate supporting rods 10 are merely connected together.

The main supporting rod 10 is provided with at least one band 17 having a handle 18 which can be rotated to function as a center support when converting the structure to a tent. The user can easily swing the hammock by grasping the handle 18 (FIG. 1), and furthermore can use the handle 18 to rotate the shading parasol 14 for draining off the water when it rains (FIG. 2.)

A chain 20 extends between the support members 11 for providing additional support to the support members. The support member includes an upper hook 21 for engaging a ring 22 on the netting bed 15 when a flat arrangement of the bed is desired. A lower hook 23 is used for engaging a ring 24 on the unfolded shade parasol 14 so that it can function as a tent 25 (FIGS. 3 and 4).

The connecting member 12 is a "V" shaped configured pipe, as shown in FIG. 2, which is adapted to connect with the support members 11 by inserting the support members into the pipes of the connecting members 12 and by fixing nuts 19 against support members 11. The connecting members 12 are also provided with connectors 26 for connecting with the rings 22 of the netting bed 15 through "C" rings 27.

The holding members 13 are pivotally connected to the connecting members 12 through nuts 19 so that the angle of the holding members can be adjusted. The holding members 13 are provided with holes 28 for receiving rods 29 which stretch the shading parasol 14, using loops 30, for shading the user from the sunlight. If necessary, the shading parasol 14 can be moved by the user. Also, the shading parasol 14 includes a zipper 31 so that a portion of the parasol 14 can be opened for exposing a part of the body (FIG. 1). Nuts 19 are also utilized to fix the rods 29 to the holes 28 and the main supporting rods 10 to the top pipes of the connecting members 12.

Figure 6:
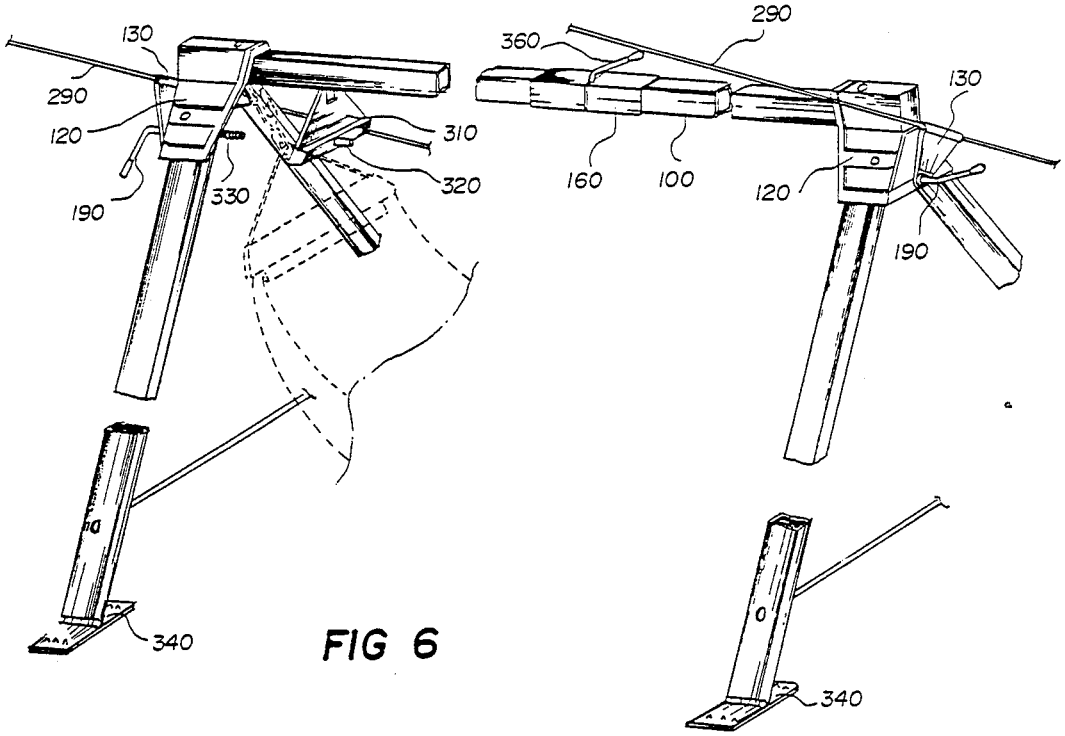
FIG. 6 is a perspective view of an embodiment of the present invention.
Figure 7:
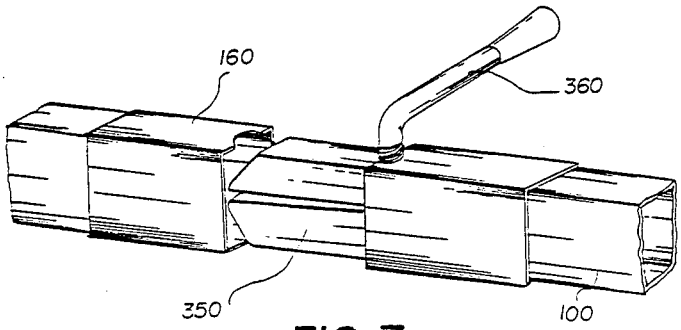
FIG. 7 is a perspective view of an embodiment of the extension member of FIG. 6.
Figure 8:
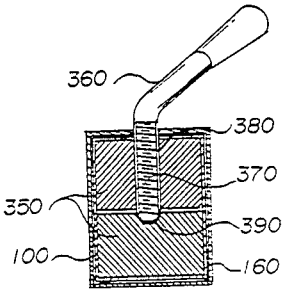
FIG. 8 is a cross-sectional view of FIG. 7.

FIGS. 6, 7 and 8 show further embodiments of the present invention. A sleeve 160 disposed at one end of the first main supporting rod 100 is provided with a fixing handle 360 for securing the main supporting rods 100 together utilizing a pair of spreading members 350. The fixing handle 360 containing a screw threaded portion 370 mates with the threaded portion 380 in the upper spreading member and the threaded portion 390 in the lower spreading member. Thus, after the spreading members 350 of the first main supporting rod 100 are inserted into the sleeve 160 of the second main supporting rod 100, the fixing handle 360 is rotated in a clockwise direction which spreads the spreading members 350 causing the main supporting rods 100 to be connected together.

Connecting members 120 are provided on one side thereof with rod holding members 130 for receiving rods 290 and on the other side with adapters 310. Adjusting handles 190 contain screw threaded portions 330 which mate with screw threaded tubes 320 located in the adapters 310. (FIG. 6) Thus, when the adjusting handle 190 is rotated in a clockwise direction, the holding member 130 is secured to the adapter 310 on opposite sides of the connecting member 120. In turn, when the adjusting handle 190 is rotated in a counterclockwise direction, the holding member and adapter is released.

A support member connected to the connecting member 120 is provided with movable standing plates 340 for accommodating the irregular conditions of the ground.

The hammock of the present invention is a very useful device which is easy to assemble, handy to carry and use in the outdoors, and simple to manufacture.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A hammock comprising a supporting structure adapted to support a hammock bed, said supporting structure comprising:

main supporting rods connected together by an extension member, at least one of said main supporting rods being provided with a band having a handle member for rotating at least one of said main supporting rods to lengthen the supporting rods and extension member combination support members connected to said main supporting rods through end connecting members, rod holding members pivotally connected to said the connecting members, said rod holding members being provided with a hole for slidably receiving rods and being provided with a nut for adjusting the position of the rods, and a folding shade parasol attached to said rods through loops, whereby a user resting in a hammock bed attached to the supporting structure can grasp the handle member to swing the hammock bed and/or rotate the shade parasol.

2. The hammock of claim 1, wherein the hammock bed is a netting bed.

3. The hammock of claim 1, wherein the folding shade parasol is a sun blocking parasol.

* * * * *